US011611819B2

(12) United States Patent
Birch

(10) Patent No.: US 11,611,819 B2
(45) **Date of Patent: *Mar. 21, 2023**

(54) EARPHONE WITH A VENT

(71) Applicant: GN Audio A/S, Ballerup (DK)

(72) Inventor: Ole Birch, Ballerup (DK)

(73) Assignee: GN AUDIO A/S, Ballerup (DK)

( * ) Notice: Subject to any disclaimer, the term of this patent is extended or adjusted under 35 U.S.C. 154(b) by 0 days.

This patent is subject to a terminal disclaimer.

(21) Appl. No.: 17/371,827

(22) Filed: Jul. 9, 2021

(65) Prior Publication Data

US 2021/0337296 A1 Oct. 28, 2021

Related U.S. Application Data

(63) Continuation of application No. 16/690,413, filed on Nov. 21, 2019, now Pat. No. 11,095,968.

(30) Foreign Application Priority Data

Dec. 7, 2018 (EP) ..... 18211033

(51) Int. Cl.
*H04R 1/10* (2006.01)
*G10K 11/178* (2006.01)

(52) U.S. Cl.
CPC ..... *H04R 1/1016* (2013.01); *H04R 1/1041* (2013.01); *H04R 1/1075* (2013.01);
(Continued)

(58) Field of Classification Search
CPC ..... H04R 1/10; H04R 1/1008; H04R 1/1058; H04R 1/1066; H04R 1/1083;
(Continued)

(56) References Cited

U.S. PATENT DOCUMENTS 904,715 A 11/1908 Mcwilliams
D182,255 S 3/1958 Smith
(Continued)

FOREIGN PATENT DOCUMENTS

CN 108028975 5/2018
CN 108605177 9/2018
(Continued)

OTHER PUBLICATIONS

Youtube.com, Site visited Nov. 16, 2021, "Tribit X1 True Wireless Earbuds for Under $50" published by Flossy Carter on Jan. 23, 2019. Stills taken at the 2:17 and 2:19 marks: https://youtu.be/3wpMtTm5QSw (Year: 2019).
(Continued)

*Primary Examiner* — Walter F Briney, III
(74) *Attorney, Agent, or Firm* — Hamre, Schumann, Mueller & Larson, P.C.

(57) ABSTRACT

An earphone comprising housing, a speaker, a speaker protrusion extending along a protrusion axis and comprising an inner protrusion surface and an outer protrusion surface, a resilient eargel comprising an inner eargel surface and an outer eargel surface. The eargel is detachably attached to the speaker protrusion, such that the outer protrusion surface abuts an abutment part of the inner eargel surface in an abutment zone extending along the protrusion axis. The eargel is adapted to be inserted into the outer ear of a user, such that it abuts the ear canal of a user, whereby a cavity is provided between at least the speaker, the inner protrusion surface, the inner eargel surface and the ear canal. The earphone is provided with a vent channel coupling the cavity and the ambient, wherein the vent channel comprises a groove (8) in the outer protrusion surface or the inner eargel surface. The vent channel is provided between the groove in the outer protrusion surface and the inner eargel surface or
(Continued)

between the groove in the inner eargel surface and the outer protrusion surface. The groove comprises a first groove part, that extends in a plane orthogonal to the protrusion axis.

14 Claims, 5 Drawing Sheets

(52) U.S. Cl.
CPC ..... *G10K 11/17873* (2018.01); *G10K 2210/1081* (2013.01); *H04R 2201/107* (2013.01); *H04R 2460/01* (2013.01); *H04R 2460/11* (2013.01)

(58) Field of Classification Search
CPC ..... H04R 1/1091; H04R 1/20; H04R 1/22; H04R 1/28; H04R 1/2803; H04R 1/2823; H04R 1/2826; H04R 1/2846; H04R 1/2849; H04R 1/2869; H04R 1/2873; H04R 5/00; H04R 5/033; H04R 25/00; H04R 25/02; H04R 25/45; H04R 25/48; H04R 25/60; H04R 25/604; H04R 25/65; H04R 25/652; H04R 25/656; H04R 2201/10; H04R 2201/105; H04R 2225/00; H04R 2225/021; H04R 2225/023; H04R 2225/025; H04R 2225/77; H04R 2460/00; H04R 2460/0109; H04R 2460/11
See application file for complete search history.

(56) References Cited

U.S. PATENT DOCUMENTS 3,902,628 A 9/1975 Schurman
D266,271 S 9/1982 Johanson
D289,262 S 4/1987 Goetz
D291,608 S 8/1987 Chevassus
4,702,238 A 10/1987 Scott
5,353,946 A 10/1994 Behrend
5,782,371 A 7/1998 Baerenwald et al.
D406,057 S 2/1999 Hager
D449,165 S 10/2001 van der Hulst
D469,607 S 2/2003 Wolff
D553,077 S 10/2007 Kim et al.
D586,557 S 2/2009 Jalet
D597,084 S 7/2009 Gondo
7,784,583 B1 8/2010 Hall
D631,470 S 1/2011 Yoneyama
D635,558 S 4/2011 Zheng
D641,010 S 7/2011 Kwon
D641,164 S 7/2011 Cornu et al.
8,189,846 B2 * 5/2012 Tiscareno ..... H04R 1/1016 381/380
D668,244 S 10/2012 Matsumura
D673,430 S 1/2013 Glassman
D687,021 S 7/2013 Yuen
D697,058 S 1/2014 Alden et al.
D711,858 S 8/2014 Yang
8,910,781 B2 12/2014 Pipes
9,237,394 B2 1/2016 Seo et al.
9,445,631 B1 9/2016 Patel et al.
D772,572 S 11/2016 Palmborg et al.
D778,156 S 2/2017 Follett et al.
D800,097 S 10/2017 Chen
D806,388 S 1/2018 Akana et al.
D806,648 S 1/2018 Beedham et al.
D806,879 S 1/2018 Horbinski et al.
D810,431 S 2/2018 Kim et al.
D817,309 S 5/2018 Czaniecki et al.
D818,268 S 5/2018 Akana et al.
9,961,434 B2 5/2018 Kelly
D823,246 S 7/2018 Lin
D826,152 S 8/2018 Christiansen
D838,480 S 1/2019 Son et al.
D839,583 S 2/2019 Cao
D841,580 S 2/2019 Bao
D841,581 S 2/2019 Bonahoom
D841,626 S 2/2019 Tang
D841,627 S 2/2019 Wen
D843,354 S 3/2019 Kumano
D843,937 S 3/2019 Xiao
D845,894 S 4/2019 Clark
D845,932 S 4/2019 Lu
D846,264 S 4/2019 Wu
D849,401 S 5/2019 Akana et al.
D853,116 S 7/2019 Bergman et al.
D853,357 S 7/2019 Li
D864,110 S 10/2019 Koshimura
D870,451 S 12/2019 Birger
D870,459 S 12/2019 Lee et al.
D873,217 S 1/2020 Zhang
D873,248 S 1/2020 Zhong et al.
D878,045 S 3/2020 Akana et al.
D878,048 S 3/2020 Wang et al.
D881,572 S 4/2020 Wang et al.
D882,259 S 4/2020 Liu
D886,455 S 6/2020 Williamson et al.
D887,351 S 6/2020 Bonahoom
D887,395 S 6/2020 Wang
D888,408 S 6/2020 Lee et al.
10,692,482 B2 6/2020 Zhu
10,701,472 B1 6/2020 Xu et al.
10,715,905 B2 7/2020 Wen
D893,184 S 8/2020 Liu
D893,185 S 8/2020 Liu
D894,123 S 8/2020 Xiong
D895,580 S 9/2020 Yu
D896,205 S 9/2020 Zhang et al.
D897,678 S 10/2020 Koh
D897,997 S 10/2020 Zhang
D898,664 S 10/2020 Bhutani
D901,377 S 11/2020 Zhou
D902,588 S 11/2020 Zhang
10,827,249 B1 11/2020 Pine et al.
D904,025 S 12/2020 Ma
D904,755 S 12/2020 Birger
D905,664 S 12/2020 He
D906,238 S 12/2020 Zhang et al.
D906,299 S 12/2020 Luo
D908,084 S 1/2021 He
D908,667 S 1/2021 He
D909,995 S 2/2021 Cai
D910,603 S 2/2021 Li et al.
D911,027 S 2/2021 Liang
D912,622 S 3/2021 Zhou
D913,223 S 3/2021 Li
D914,591 S 3/2021 Ganapathy et al.
D918,138 S 5/2021 Ma
D918,181 S 5/2021 Bailey et al.
D920,235 S 5/2021 Liu
D920,236 S 5/2021 Xie
D920,958 S 6/2021 Ye
D921,582 S 6/2021 Liu
D922,315 S 6/2021 Zhang
D922,358 S 6/2021 Li
D922,946 S 6/2021 Chen
D922,985 S 6/2021 Kataoka
D927,417 S 8/2021 Sretovic
D927,465 S 8/2021 Wang et al.
D928,124 S 8/2021 Liu
D929,378 S 8/2021 Li
D929,969 S 9/2021 Ding
D929,970 S 9/2021 Lin
D930,617 S 9/2021 Tanaka
D930,620 S 9/2021 Lindenberger
D930,622 S 9/2021 Lin
D931,256 S 9/2021 Lu
D931,258 S 9/2021 Ding
D931,605 S 9/2021 Zhu
D931,861 S 9/2021 Zhong et al.
D932,427 S 10/2021 Schoeck et al.
D932,428 S 10/2021 Reimann et al.
D933,597 S 10/2021 Natsume et al.

(56) References Cited

U.S. PATENT DOCUMENTS

| | | | | |
|---|---|---|---|---|
| D935,772 | S | 11/2021 | Chen | |
| D936,040 | S | 11/2021 | Zhao et al. | |
| D939,830 | S | 1/2022 | Laffon de Mazieres et al. | |
| D940,109 | S | 1/2022 | Birger | |
| D943,553 | S | 2/2022 | Zhang | |
| D943,555 | S | 2/2022 | Deng | |
| D944,197 | S | 2/2022 | Li | |
| 2002/0096517 | A1 | 7/2002 | Gelardi | |
| 2008/0090622 | A1 | 4/2008 | Kim et al. | |
| 2010/0246878 | A1* | 9/2010 | Sim | H04R 1/1041 381/380 |
| 2012/0321103 | A1* | 12/2012 | Smailagic | H04R 1/1041 381/98 |
| 2013/0148830 | A1* | 6/2013 | Sakaguchi | H04R 1/2869 381/312 |
| 2014/0064548 | A1 | 3/2014 | Chu | |
| 2014/0348372 | A1* | 11/2014 | Seo | H04R 1/1016 381/380 |
| 2017/0064429 | A1 | 3/2017 | Hirsch et al. | |
| 2018/0020281 | A1 | 1/2018 | Wurtz | |
| 2018/0060031 | A1 | 3/2018 | Boesen | |
| 2018/0286375 | A1* | 10/2018 | Cattell | G10K 11/178 |
| 2018/0338193 | A1* | 11/2018 | Wallace | H04R 1/1075 |
| 2019/0069066 | A1 | 2/2019 | Song et al. | |
| 2019/0124433 | A1 | 4/2019 | Jo et al. | |
| 2020/0186906 | A1 | 6/2020 | Birch | |
| 2020/0304899 | A1 | 9/2020 | Cramer et al. | |
| 2020/0321792 | A1 | 10/2020 | Rhee et al. | |
| 2021/0085047 | A1 | 3/2021 | Wright et al. | |
| 2021/0250708 | A1 | 8/2021 | Kheraj | |
| 2021/0259378 | A1 | 8/2021 | Jones | |
| 2021/0289282 | A1 | 9/2021 | Onizuka et al. | |
| 2021/0392426 | A1 | 12/2021 | You et al. | |

FOREIGN PATENT DOCUMENTS

| | | |
|---|---|---|
| CN | 305053419 | 3/2019 |
| EM | 007971882-0001 | 5/2020 |
| EM | 08049761-0001 | 7/2020 |
| EM | 008428452-0001 | 2/2021 |
| EM | 008508840-0001 | 4/2021 |
| EP | 2736267 | 5/2014 |
| GB | 6127872 | 4/2021 |
| GB | 6188747 | 1/2022 |
| HK | 2118076-0002 | 5/2021 |
| JP | 2015109542 | 6/2015 |
| KR | 300955725 | 5/2018 |
| KR | 301005218.0000 | 5/2019 |
| TW | 215431-0001 | 8/2020 |
| WO | D091753-001 | 7/2016 |
| WO | 2017147545 | 8/2017 |

OTHER PUBLICATIONS

Amazon.com, Site visited Nov. 15, 2021, Tozo T6 True Wireless Earbuds, First Available May 9, 2019, https://www.amazon.com/TOZO-T6- Bluetooth-Headphones-Waterproof/dp/B07RGZ5NKS (Year: 2019).

Amazon.com, Site visited Nov. 15, 2021, EarFun Wireless Earbuds, First Available Aug. 30, 2019, https://www.amazon.com/ EarFun-Bluetooth-Waterproof-Earphones-Headphones/dp/B07S4D8M34 (Year: 2019).

Extended European Search Report for European patent application No. 18211033.8 dated May 23, 2019.

* cited by examiner

EARPHONE WITH A VENT

TECHNICAL FIELD

The invention relates to an earphone comprising housing, a speaker, a speaker protrusion extending along a protrusion axis and comprising an inner protrusion surface and an outer protrusion surface, a resilient eargel comprising an inner eargel surface and an outer eargel surface, whereby the eargel is detachably attached to the speaker protrusion, such that the outer protrusion surface abuts a part of the inner eargel surface in an abutment zone, the eargel being adapted to be inserted into the outer ear of a user, such that the outer eargel surface abuts the ear canal of a user, whereby a cavity is provided between the speaker, the inner protrusion surface, the inner eargel surface and the ear canal, and wherein the earphone is provided with a leakage hole/vent coupling the cavity and the ambient, wherein the vent comprises a groove in the outer protrusion surface or the inner eargel surface, whereby a vent channel is provided between the groove and the inner eargel surface or the outer protrusion surface.

BACKGROUND ART

An earphone of type mentioned above can be used for listening to audio, such as music. If it is embodied as a headset or being a part of a headset, it can be used for two-way communication. It can be corded and plugged into a smartphone or computer, or it can be wireless and be provided with a transceiver, such as a Bluetooth transceiver. An earphone of this type can fit sealing in the in the entrance of the ear canal, which can give some advantage but also some disadvantages. An advantage is that ambient noise can be blocked out ensuring that the user better can hear the audio generated by the speaker in noisy conditions. Another advantage is, that less energy is needed to provide high quality sound especially at lower frequencies. A disadvantage is, that a high air pressure may occur in the ear canal, when the eargel is inserted, which may cause discomfort for the user and/or damage the speaker membrane and/or decrease the sound quality. Therefore, it is desired to provide a controlled vent which provides pressure equalizing without eliminating the positive acoustic properties provided by a sealed/closed fitting.

U.S. Pat. No. 7,784,583 discloses an earphone type of type above with a vent provided as a thin channel extending in the eargel between the cavity and ambient. U.S. Pat. No. 9,237,394 discloses an earphone of the type above, where a groove is provided in the inner surface of the eargel, whereby a vent channel is provided between the eargel and the outer protrusion surface. Also, U.S. Pat. No. 8,189,846 BB discloses an earphone, wherein a vent channel is provided on the inner side of the eargel.

DISCLOSURE OF INVENTION

The earphone according to the preliminary part is characterised in that the groove comprises a first groove part, that extends in a plane orthogonal to the protrusion axis. Such a channel is easy to provide during manufacturing of the speaker protrusion or the eargel, and because a first groove part extends in a plane orthogonal to the protrusion axis, a certain length of the channel can be obtained without making the speaker protrusion unnecessary long.

According to an embodiment, the first groove part has a length of at least 5 mm, 10 mm, 12 mm, 16 mm or 20 mm.

According to an embodiment, the first groove part extends in the outer protrusion surface and at least along a fourth, a third or half of periphery of the outer protrusion surface.

According to an embodiment, the first groove part communicates with a through-going bore connecting the inner protrusion surface and the outer protrusion surface.

According to an embodiment, a second groove part extends in the outer protrusion surface from the first groove part along the protrusion axis beyond the abutment zone.

According to an embodiment, cross-section of the vent channel is less than 2 $mm^2$, 1 $mm^2$, 0.8 $mm^2$ or 0.5 $mm^2$.

According to an embodiment, the first groove part is provided in the inner eargel surface.

According to an embodiment, the abutment zone extends along the full length of the speaker protrusion.

According to an embodiment, the second groove part extends into the outer side of the housing.

According to an embodiment, the speaker protrusion has an oval cross-section.

According to an embodiment, at any given position, the first groove part extends perpendicular to an axis extending orthogonally from the protrusion axis to the given position.

According to an embodiment, the vent channel is dimensioned to provide a cut-off frequency of approximately 20 Hz.

According to an embodiment, a feedback active noise cancelling microphone is provided in the earphone housing.

The invention also relates to headset comprising an earphone described above and at least one voice microphone for picking up voice of a user of the headset.

BRIEF DESCRIPTION OF THE DRAWINGS

The invention is explained in detail below with reference to the drawing illustrating a preferred embodiment of the invention and in which.

MODES FOR CARRYING OUT THE INVENTION

Figure 1:
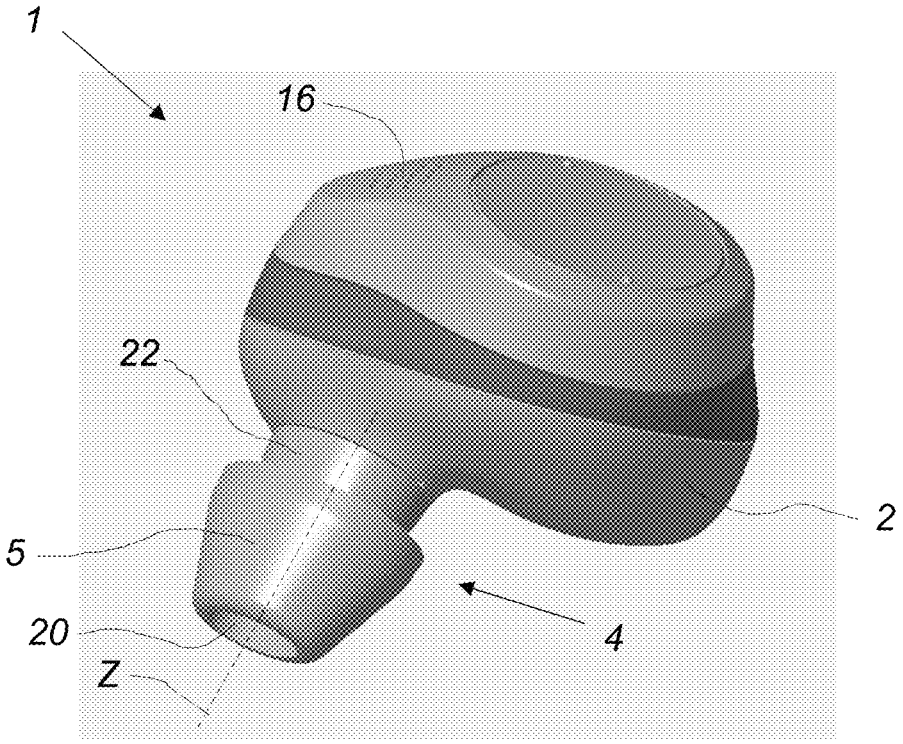
FIG. 1 is a perspective view of an earphone with a speaker protrusion and an eargel according to a first embodiment of the invention.
Figure 2:
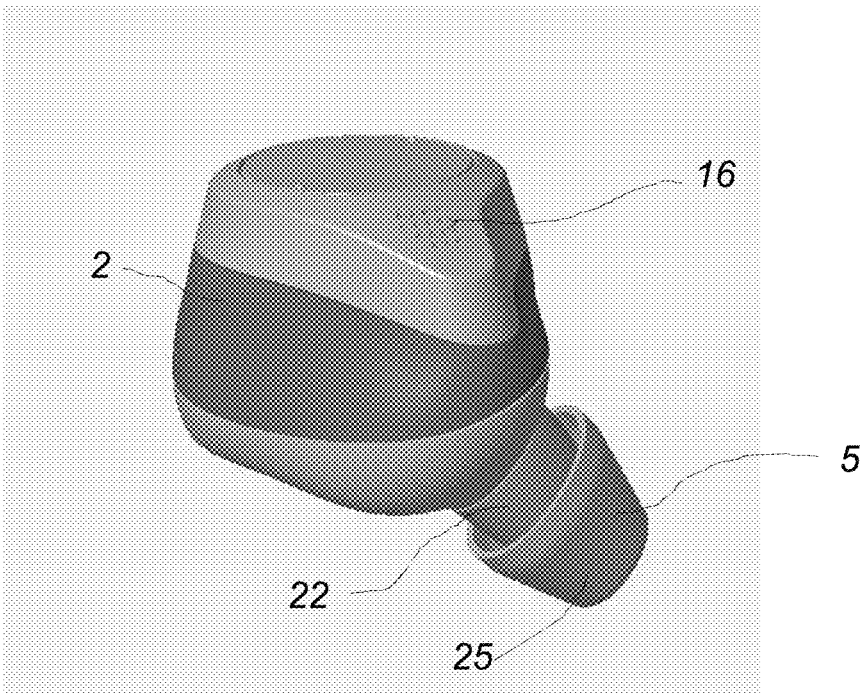
FIG. 2 is another perspective of the earphone.

FIGS. 1 and 2 are perspective views of an earphone 1 with a speaker protrusion and an eargel 5 according to a first embodiment of the invention. The earphone 1 is embodied as a wireless headset for two-way communication. The headset 1 comprises a housing 2, a speaker protrusion 4 and an eargel 5 of resilient material attached to the speaker protrusion 4. The housing 4 holds a speaker, signal processing electronics, a DA/AD converter, a rechargeable battery, a Bluetooth™ transceiver etc. Microphone openings 16 in the housing 2 provides acoustic access to the microphone(s).

The headset 1 is a part of a "truly wireless" headset comprising two earphones 1, one for each ear. They both communicate via the Bluetooth™ standard with a smartphone or the like. However, they could also have been adapted to communicate directly with each other, f. ex. by magnetic induction. The headset 1 shown in FIG. 1 can also be used alone as a monaural headset. After insertion of the eargel 5 into the ear canal of the user, the headset 1 remains in place due to friction between a deformable eargel skirt 25 of the eargel 5 and the internal wall of the ear canal opening. The headset 1 is adapted to be used with the right ear of a user.

Figure 3:
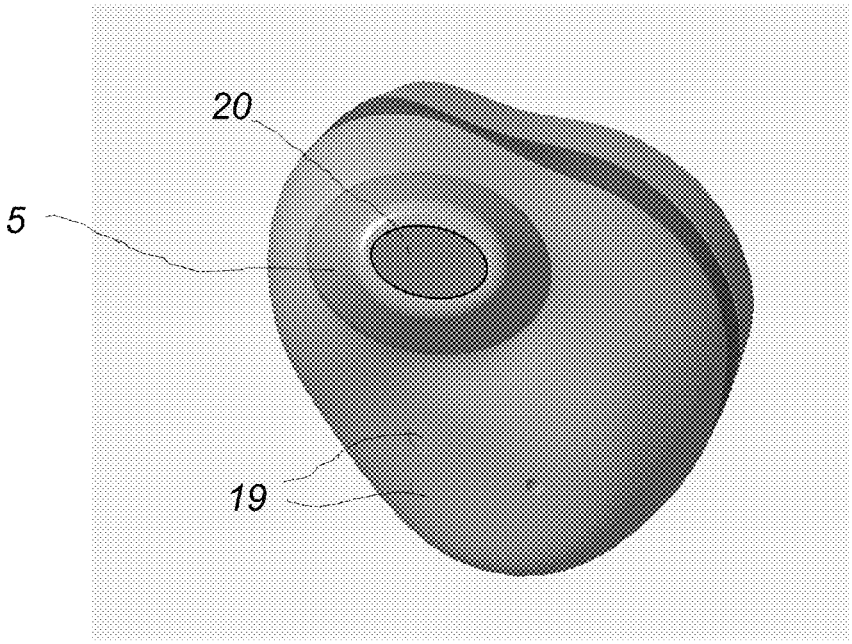
FIG. 3 is a top view of the earphone.

FIG. 3 is a top view of the earphone 1. The speaker protrusion 4 and the eargel 5 have oval cross-sections. Charging terminals 19 are provided for charging the battery of the headset 1. A sound outlet 20 of the eargel 5 conducts audio from the speaker to the ear canal of the user during use.

Figure 4:
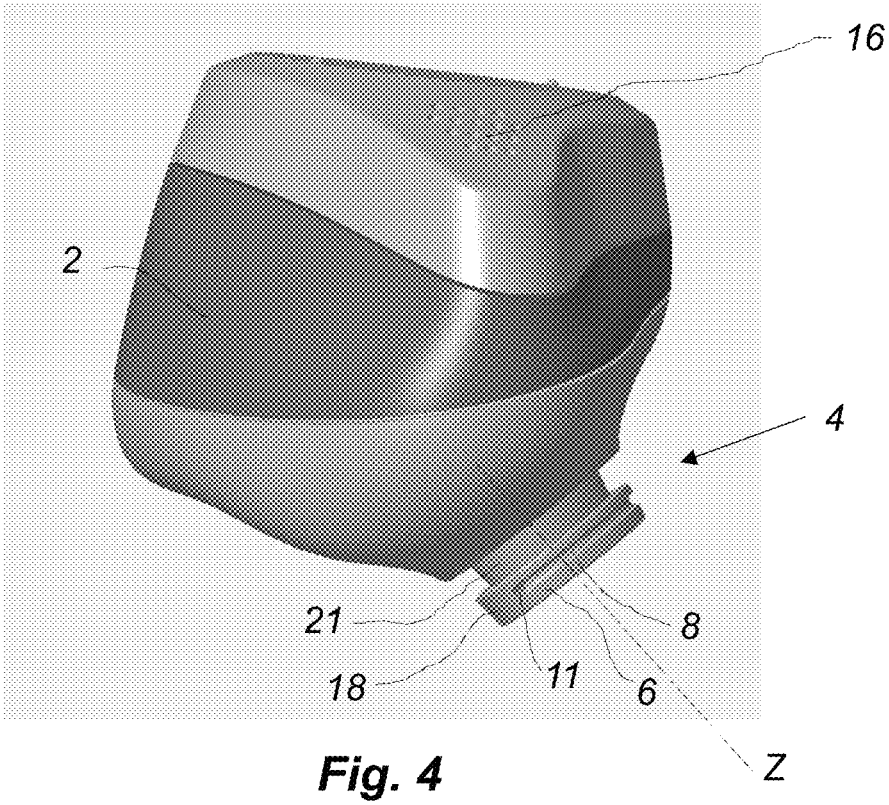
FIG. 4 is a perspective view of the headset with the eargel removed.

FIG. 4 is a perspective view of the headset 1 with the eargel 5 removed. The eargel 3 can be replaced with another eargel of a different size in order to adapt the headset 1 to the user's ear. Or it can be taken of to be cleaned or replaced due to wear. The speaker protrusion 4, which is an integral part of the housing 2, is approximately 2.7 mm high in the Z-direction. It has a stem part 21 and a rim part 18 with a larger diameter than the stem part 21. The stem part 21 is approximately 7.8 mm wide at the widest place and 5.4 mm wide at the narrowest place. The rim part 18 is approximately 1.5 mm high in the Z-direction. It is approximately 9 mm wide at the widest place and approximately 6.6 mm wide at the narrowest place. The internal diameter of the protrusion 4 varies between approximately 4.0 mm and 6.4 mm. A through-going bore 11 in the rim part 18 and a groove 8 in the outer protrusion surface of rim part 18 will be explained further below in relation to the description of FIGS. 5 and 6.

Figure 8:
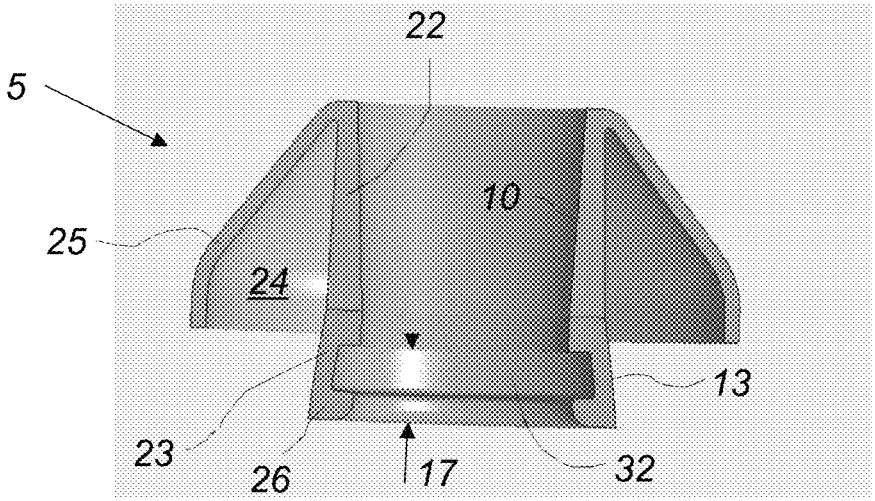
FIG. 8 is a cross-sectional view through the eargel.

FIG. 8 is a cross-sectional view of the eargel 5. The eargel 5 has a core part 22 and an outer eargel skirt 25. The eargel 5 is divided in to a stiff portion 23 and a soft portion 24. The soft portion 24 comprise an upper part of the core portion 22 and the thin-walled flexible eargel skirt 25. The lower, stiff part 23 of the core portion 22 is made of a more rigid material and co-molded with the soft part 24. The eargel skirt 25 adapts to the entrance of the ear canal when inserted to provide a close fit. The stiff part 23 of the core portion 22 is having a core recession 32 and a lower core rim 26.

Figure 5:
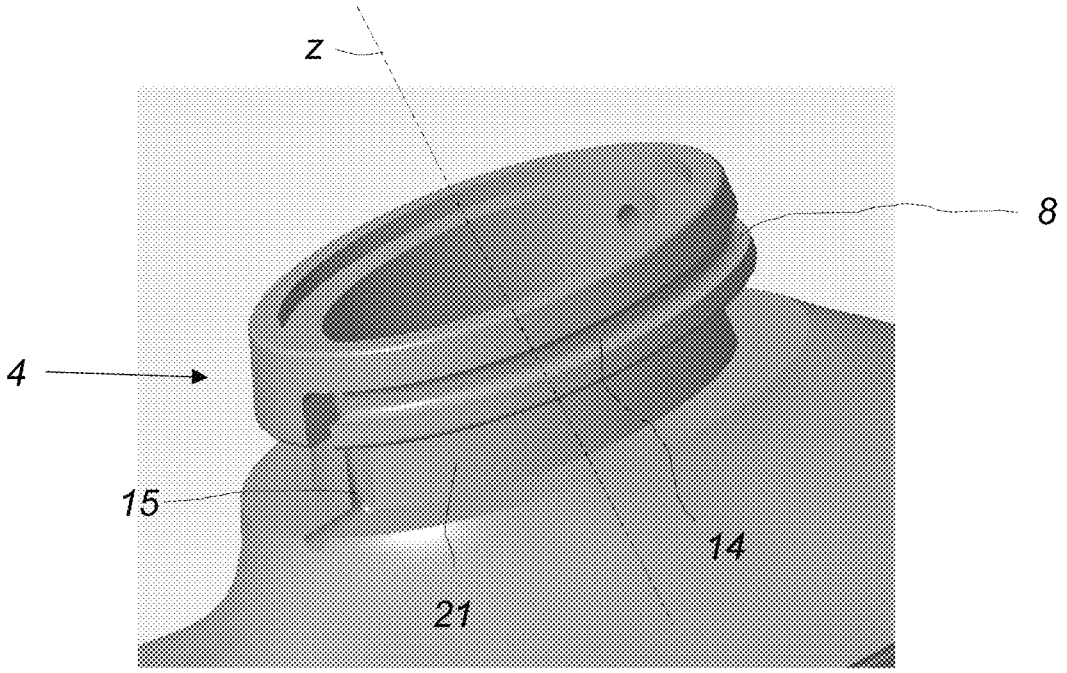
FIG. 5 is a perspective view of the area with the speaker protrusion.
Figure 6:
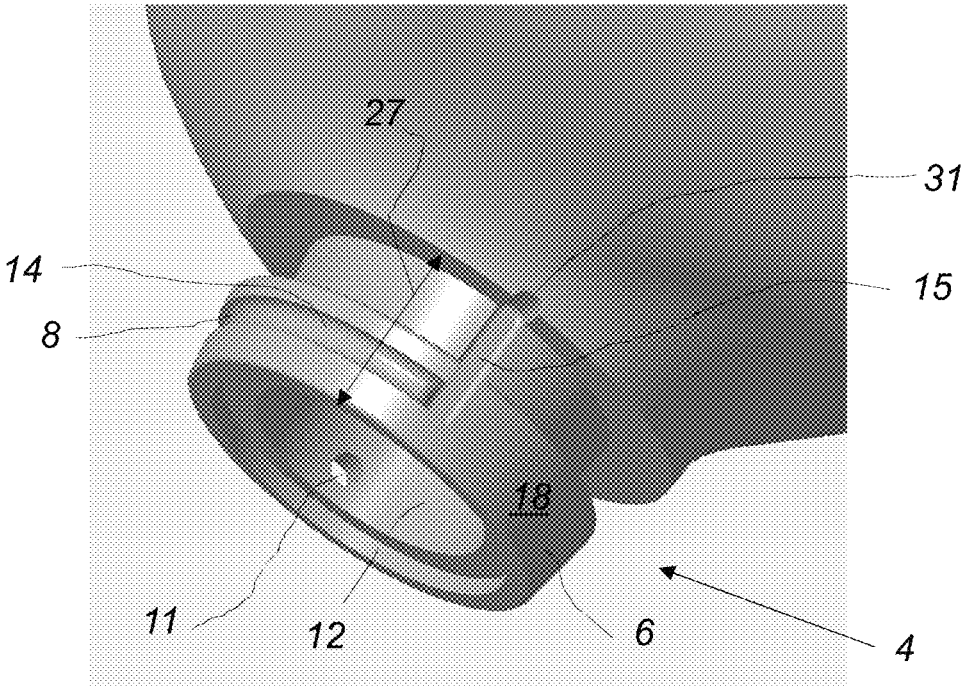
FIG. 6 is the area of FIG. 5 shown from another angle.

FIGS. 5 and 6 are different a perspective views of the area with the speaker protrusion 4. The speaker protrusion 4 has a stem part 21 and a rim part 18 with a larger diameter than the stem part 21. The rim part 18 of the speaker protrusion 4 is adapted to be received in the eargel recession 32 of the eargel 5. The rigid core part 23 is resilient enough to be expanded when the eargel 4 is attached to the speaker protrusion 4. The outer protrusion surface 6 has a first groove part 14 and a second grove part 15. The first groove part 14 extends approximately 180 degrees around the periphery of the speaker protrusion 4 in a plane approximately orthogonal to the speaker protrusion axis Z. The first groove part 14 is approximately 0.5 mm wide and 0.25 mm deep. At one end the first groove part 14 communicates with the second groove part 15, which extends approximately parallel to the protrusion axis Z to an outlet 31 beyond the stem part 21. The other end of the first groove part 14 communicates with a through-going bore 11 going from the outer protrusion surface 6 to the inner protrusion surface 12. The bore has a diameter of approximately 0.5 mm. When the eargel 5 is attached to the protrusion 4, a vent channel 9 is provided from the inside of the speaker protrusion 4 to the ambient. This vent channel 9 is delimited by the bore 11, the first and second groove parts 14, 15 and the rigid core part 23 of the eargel 5.

Figure 7:
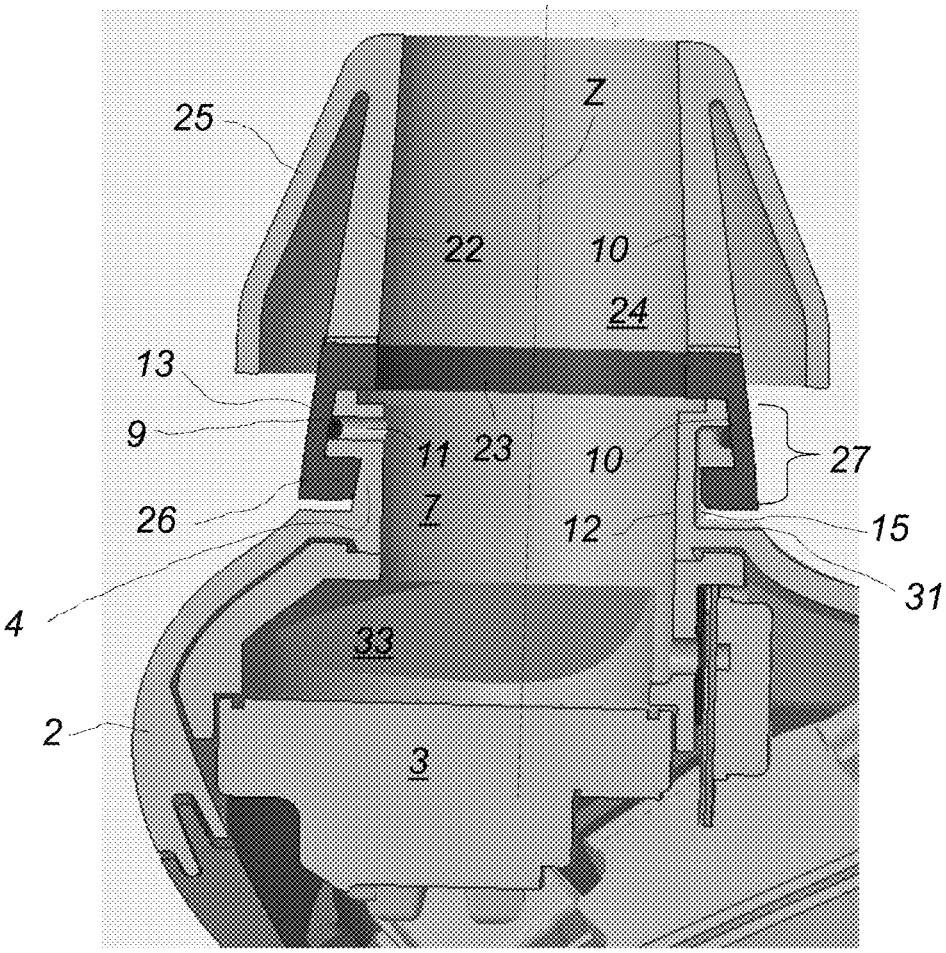
FIG. 7 is a cross-sectional view through the speaker protrusion and the eargel.

FIG. 7 is a cross-sectional view through the speaker protrusion 4 and the eargel 5. The speaker 3 is shown schematically inside the housing 2. To the left of the protrusion axis Z, the bore 11 is visible. To the right of the protrusion axis Z, the second groove part 15 and the outlet 31 in the housing 2 are visible. The first groove part 14 extends between the bore 11 and the second groove part 15 behind the plane of FIG. 7. When the earphone 1 is inserted into the ear of a user, a "front chamber" or cavity 7 is established between the speaker 7, a front chamber wall 33, the inner protrusion surface 12, the inner eargel surface 10 and the user's ear. During the insertion into the ear, the air pressure in the cavity would rise if the headset 1 was not provided with the vent channel 9. If there were no vent channel, the high air pressure could cause discomfort for the user, as the eardrum would be exposed to a high pressure. Also, the speaker diaphragm could be exposed to such a high pressure, that it could break. The vent channel 9 has a length of 12 mm and it therefore acts as a low-pass filter, which in practice only lets sounds with frequencies below 20 HZ pass. Thus, the air pressure is equalised with the ambient air pressure in real time. However, as only very low frequencies pass the vent channel, the cavity is in practice acoustically closed. Thus, the acoustic advantages of a closed cavity are maintained. The low pass filter characteristics of channel 9 are determined by the length and the cross section. A cut-off frequency of 20 Hz could also have been obtained by a much shorter channel if the cross section was much smaller also. However, a channel running parallel with the speaker protrusion axis Z alone would have such a small cross sectional, that it could be problematic to manufacture products with uniform properties, as tolerances and worn moulds would affect the properties.

Figure 9:
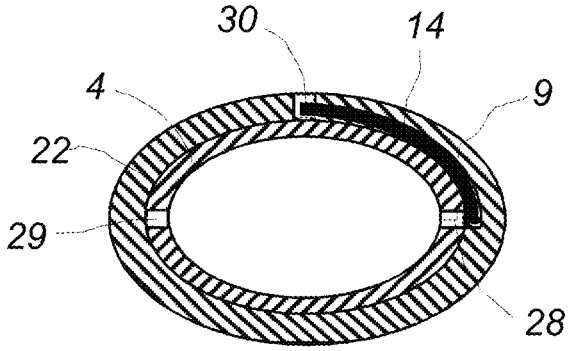
FIG. 9 is a cross-sectional view through a second embodiment.
Figure 10:
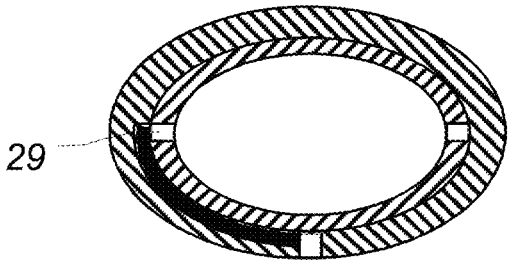
FIG. 10 is another cross-sectional view through the second embodiment.

FIGS. 9 and 10 are schematic cross-sectional views of an alternative embodiment. Here the first groove part 14 is provided in the inner eargel surface 10. One end of the first groove part 14 communicates with a bore 30 in the core part 22 of the eargel. The other end of the first groove part 14 communicates with a first bore 28 in the speaker protrusion 4. As the core part 22 and the speaker protrusion 4 have oval cross-sections, the eargel 4 can be attached in two positions, which are displaced 180 degrees in relation to each other. If the eargel is attached in the other position as shown in FIG. 10, the first groove part 14 will communicate with a second bore 29 in the speaker protrusion. Thus, a vent channel will be provided in any case, so the user can not attach the eargel in a wrong way.

The cross-sections of the speaker protrusion 4 and the eargel 5 can have other shapes and f. ex. be circular.

| Reference signs: | |
|---|---|
| Z | speaker protrusion axis |
| 1 | Headset |
| 2 | Housing |
| 3 | Speaker |
| 4 | Speaker protrusion |
| 5 | Eargel |
| 6 | outer protrusion surface |
| 7 | cavity |
| 8 | groove |
| 9 | vent channel |
| 10 | inner eargel surface |

-continued

| Reference signs: | |
|---|---|
| 11 | through-going bore |
| 12 | inner protrusion surface |
| 13 | outer eargel surface |
| 14 | first groove part |
| 15 | second groove part |
| 16 | microphone openings |
| 17 | abutment part of inner eargel surface |
| 18 | rim part of speaker protrusion |
| 19 | charging terminals |
| 20 | sound outlet |
| 21 | stem part of protrusion |
| 22 | core part |
| 23 | stiff portion of core part |
| 24 | soft portion eargel |
| 25 | eargel skirt |
| 26 | core rim |
| 27 | abutment zone |
| 28 | first bore in speaker protrusion |
| 29 | second bore in speaker protrusion |
| 30 | outlet in core part |
| 31 | outlet in housing |
| 32 | core recession |
| 33 | front chamber wall |

The invention claimed is:

1. An earphone comprising housing, a speaker protrusion extending along a protrusion axis and comprising an inner protrusion surface and an outer protrusion surface, a resilient eargel comprising an inner eargel surface and an outer eargel surface, the outer protrusion surface abuts an abutment part of the inner eargel surface in an abutment zone extending along the protrusion axis, the inner protrusion surface, the inner eargel surface and the ear canal, and wherein the earphone is provided with a vent channel coupling the cavity and the ambient, wherein the vent channel includes a groove in the outer protrusion surface or the inner eargel surface, the vent channel being provided between the groove in the outer protrusion surface and the inner eargel surface or between the groove in the inner eargel surface and the outer protrusion surface, wherein that the groove includes a circumferential groove part; and further including a fluid connection between the circumferential groove part and the inner protrusion surface to provide pressure equalization therebetween.

2. An earphone according to claim 1, wherein the circumferential groove part has a length of at least 5 mm, 10 mm, 12 mm, 16 mm or 20 mm.

3. An earphone according to claim 2, wherein the circumferential groove part extends in the outer protrusion surface and at least along a fourth, a third or half of periphery of the outer protrusion surface.

4. An earphone according to claim 1, wherein the first groove part is provided in the inner eargel surface.

5. An earphone according to claim 4, wherein the abutment zone extends along the full length of the speaker protrusion.

6. An earphone comprising housing, a speaker protrusion extending along a protrusion axis and comprising an inner protrusion surface and an outer protrusion surface, a resilient eargel comprising an inner eargel surface and an outer eargel surface, the outer protrusion surface abuts an abutment part of the inner eargel surface in an abutment zone extending along the protrusion axis, the inner protrusion surface, the inner eargel surface and the ear canal, and wherein the earphone is provided with a vent channel coupling the cavity and the ambient, wherein the vent channel includes a groove in the outer protrusion surface or the inner eargel surface, the vent channel being provided between the groove in the outer protrusion surface and the inner eargel surface or between the groove in the inner eargel surface and the outer protrusion surface, wherein that the groove includes a circumferential groove part; and further including a fluid connection between the first circumferential groove part and the inner protrusion surface; and wherein the first groove part communicates with a through-going bore connecting the inner protrusion surface and the outer protrusion surface.

7. An earphone according to claim 6, wherein a second groove part extends in the outer protrusion surface from the first groove part along the protrusion axis beyond the abutment zone.

8. An earphone according to claim 7, wherein the cross-section of the vent channel is less than 2 $mm^2$, 1 $mm^2$, 0.8 $mm^2$ or 0.5 $mm^2$.

9. An earphone according to claim 6, wherein the second groove part extends into the outer side of the housing.

10. An earphone according to claim 9, wherein the speaker protrusion has an oval cross-section.

11. An earphone according to claim 10, wherein the vent channel is dimensioned to provide a cut-off frequency of approximately 20 Hz.

12. An earphone according to claim 11, wherein a feedback active noise cancelling microphone is provided in the earphone housing.

13. A headset comprising an earphone according to claim 12 and at least one voice microphone for picking up voice of a user of the headset.

14. An earphone comprising a housing, a speaker protrusion extending along a protrusion axis and comprising an inner protrusion surface and an outer protrusion surface, a resilient eargel comprising an inner eargel surface and an outer eargel surface, such that the outer protrusion surface abuts an abutment part of the inner eargel surface in an abutment zone extending along the protrusion axis, the inner protrusion surface, the inner eargel surface and the ear canal, and wherein the earphone is provided with a vent channel coupling the cavity and the ambient, wherein the vent channel includes a groove in the outer protrusion surface or the inner eargel surface, the vent channel being provided between the groove in the outer protrusion surface and the inner eargel surface or between the groove in the inner eargel surface and the outer protrusion surface wherein that the groove that extends in a plane orthogonal to the protrusion axis and wherein the groove communicates with a through-going bore connecting the inner protrusion surface and the outer protrusion surface, thereby providing a pressure equalization path.

* * * * *